United States Patent [19]

Ting

[11] Patent Number: 4,700,520

[45] Date of Patent: Oct. 20, 1987

[54] SIDE JOINT OF COMPOSITE METAL PANEL

[76] Inventor: Raymond M. L. Ting, 318 Holiday Dr., Pittsburgh, Pa. 15237

[21] Appl. No.: 877,304

[22] Filed: Jun. 23, 1986

[51] Int. Cl.[4] ..... E04C 1/10; E04C 2/20; E04D 1/34

[52] U.S. Cl. ..... 52/478; 52/309.9; 52/520; 52/544

[58] Field of Search ..... 52/478, 520, 528, 544, 52/545, 595, 588, 521, 309.2, 309.9, 394, 512, 483, 512, 594, 802, 803, 804

[56] References Cited

U.S. PATENT DOCUMENTS

| | | | |
|---|---|---|---|
| 3,714,747 | 2/1973 | Curran | 52/309.2 |
| 4,177,615 | 12/1979 | Anderson | 52/544 X |
| 4,184,301 | 1/1980 | Anderson et al. | 52/478 |
| 4,316,351 | 2/1982 | Ting | 52/520 X |

*Primary Examiner*—William F. Pate, III
*Assistant Examiner*—Richard E. Chilcot, Jr.
*Attorney, Agent, or Firm*—William J. Ruano

[57] ABSTRACT

This invention relates to a composite wall panel structure consisting of two metal facing skins sandwiched with a structural core. The sealing and structural performances of the panel sidejoint are significantly improved. This invention is particularly useful for panels erected in the horizontal mode.

10 Claims, 4 Drawing Figures

SIDE JOINT OF COMPOSITE METAL PANEL

BACKGROUND OF THE INVENTION

1. Field of the Invention

This invention relates to building wall or roof structures and, more particularly, to composite metal panels with concealed fastening systems. The composite metal panel consists of a structural core material sandwiched between two exterior metal skins. The metal skins are commonly painted carbon steel, aluminum, or stainless steel of thicknesses ranging from 0.018" (0.46 mm) to 0.048" (1.22 mm). The skins act compositely to resist external bending loads such as wind or roof loads by way of shear transfer through the structural core. Structural foam, paper honeycomb, or aluminum honeycomb is normally utilized as the core material. The core is structurally connected to the metal skins by chemical or adhesive bond.

2. Description of the Prior Art

Composite metal panels have been widely used in building wall and roof structures due to their high strength-to-weight ratio. The depth of the panel normally ranges from 1 inch (25 mm) to 8 inches (203 mm), depending on load or thermal insulation requirements. The width of the panel normally ranges from 12 inches (305 mm) to 48 inches (1219 mm). The panels are fastened to the building frame members, such as horizontal wall girts, vertical mullions, or roof purlins in a side-by-side fashion to form the wall or the roof surface. The finished wall or roof surface must be sealed against air and water infiltration. The side joint between two panels is sealed by a proper sealant, such as caulking or gasket. To prevent relative movement between two panels at the side joint location from damaging the sealing property, the side joint is commonly profiled to have an engaging male and female joining device whereby the sealant is secured within the female groove. In order to conceal the fasteners, a fastener pocket is provided within the depth of the panel at the side joint locations. The erection procedure involves engaging one side of the panel (i.e., the free side) and fastening the other side to the building frame (i.e., the fixed side). The fastener head on the fixed side will be concealed by the exterior panel surface of the free side. Under negative wind load conditions (i.e., the internal pressure being greater than the external pressure), the free side tends to pull away from the fixed side. This tendency of side joint separation is resisted by the male and female joining device.

In addition to the structural and weather sealing requirements, a composite panel is often designed to provide thermal insulation. In this function, the exterior metal skin is arranged to have no contact with the interior metal skin to prevent through conductivity. Accordingly, one set of male and female joining devices is provided on each skin independently. On one side of the panel, there is an interior male spline and and exterior female groove while on the other side of the panel, there is an interior female groove and an exterior male spline. Normally, the exterior male spline is utilized to cover up the fastener pocket. Therefore, the side with the interior male spline is the fixed side of the panel.

As discussed above, the male and female joining device serves to provide a means for sealing the side joint and a structural component for resisting the side joint separation under load. The side joint strength is dependent on the bending stiffness of the male splines. Since the male spline is an extension of the metal skin which is a light gauge metal with limited stiffness, the panel strength is often governed by the side joint strength. It is also known that, to prevent premature skin delamination, it is necessary to allow the fastener on the fixed side to penetrate through both the exterior and the interior skins. The side joint strength limitation severely limits the use of lighter metal skin and/or wider panel.

There are two types of panel construction in wall application. The first type is to join the panels side-by-side to form vertical side joints which is referred to as vertical wall panel application. The second type is to join the panels side-by-side to form horizontal side joints which is referred to as horizontal wall panel application. The practical erecting procedure in the horizontal wall panel application is to erect the panel from the wall base working upwardly. In this manner, the side with the inerior male spline (i.e., the fixed side) must be positioned at the top before fastening. As a result, the exterior downward female groove is also positioned at the top side of each panel. In this configuration, any water infiltrated through the exterior seal will be trapped at the bottom of the exterior female groove creating the concern of steel skin rusting and side joint distortion due to freezing. To eliminate this problem, some existing commercial product manufacturers eliminate the engaging feature of the exterior skin. However, eliminating the exterior skin engagement further reduces the side joint strength and thus further reduces the span capability of the panel.

In recent years, it is an aesthetic preference to provide a wide exterior panel reveal joint at the side joint location whereby an accent color can be provided at the reveal joint. To provide the exterior reveal joint, the exterior male spline must be extended. As a result of extending the exterior male spline, the side joint strength is further reduced leading to a reduced span capability of the panel.

SUMMARY OF THE INVENTION

The objectives of this invention is to provide a side joint design for composite panel system suitable for wall and roof construction to achieve the following functional objectives:

1. To significantly improve the side joint strength such that the full bending strength of the panel can be utilized in design allowing the use of lighter metal skin or wider panel.

2. To eliminate the potential problem of trapping the water in the exterior female groove in horizontal wall panel application without reducing the side joint strength of the panel.

3. To allow the use of wide reveal joint without affecting the side joint strength of the panel.

BRIEF DESCRIPTION 0F THE DRAWINGS

DESCRIPTION OF THE PREFERRED EMBODIMENTS

Figure 1:
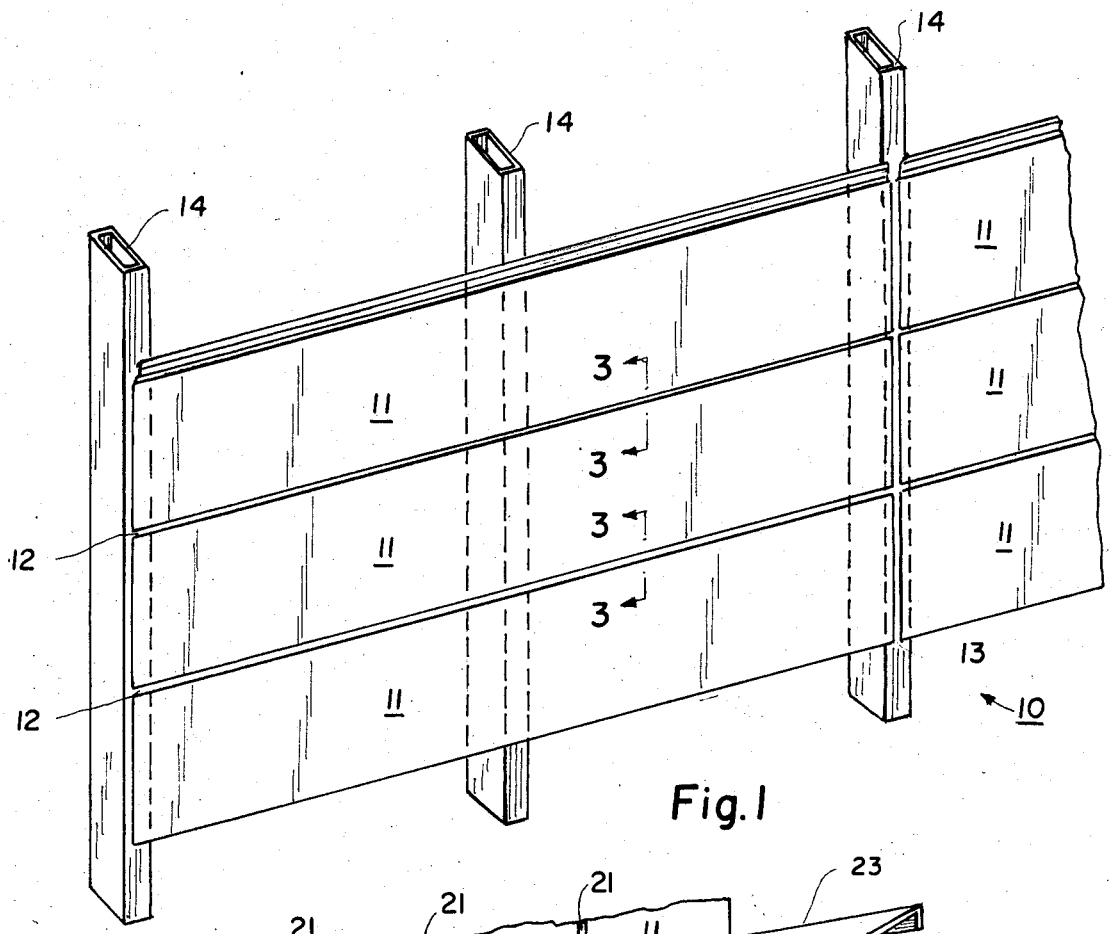
FIG. 1 is an isometric view illustrating a portion of the assembled wall structure erected in the horizontal mode with vertical supports.
Figure 3:
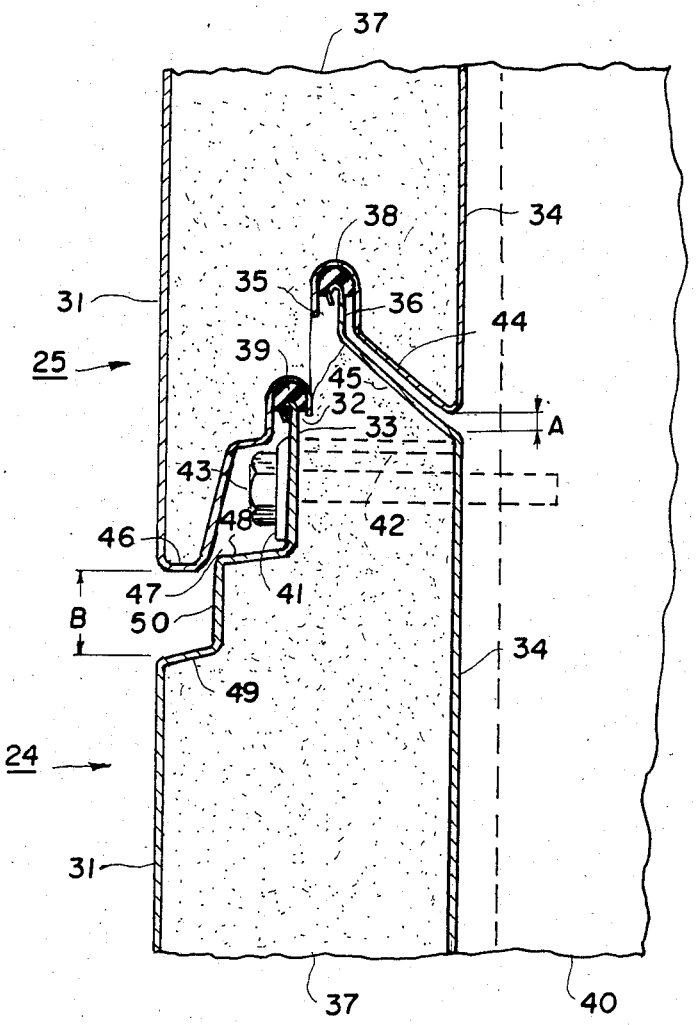
FIG. 3 is a typical fragmentary cross-sectional view taken along line 3—3 of FIG. 1 or FIG. 2 of the panel side joint of this invention.

FIG. 1 illustrates a wall structure 10 using composite foam panels 11 of this invention erected in the horizontal mode. The horizontal joints 12 between panels 11 are formed and sealed by the joinery design of this invention as shown in FIG. 3. The vertical joint 13 between panels 11 is formed by butting the ends of panels 11 and sealed from the exterior side. The panels 11 are securely fastened to horizontally spaced-apart vertical support members 14 which are part of the building frame.

Figure 2:
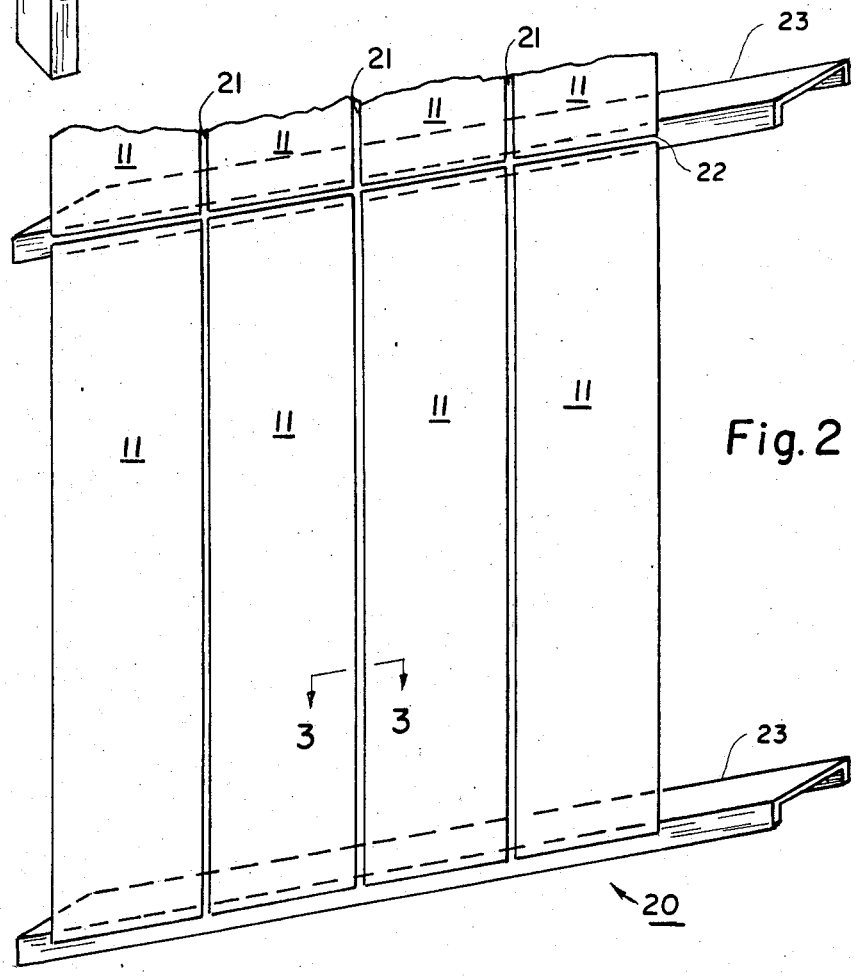
FIG. 2 is an isometric view illustrating a portion of the assembled wall structure erected in the vertical mode with horizontal supports.

FIG. 2 illustrates a wall structure 20 using composite foam panels 11 of this invention erected in the vertical mode. The vertical joints 21 between panels 11 are formed and sealed by the joinery design of this invention as shown in FIG. 3. The horizontal joint 22 between panels 11 is formed by butting the ends of panels 11 and sealed from the exterior side. The panels 11 are securely fastened to vertically spaced-apart horizontal support members 23 which are part of the building frame.

FIG. 3 shows a typical fragmentary cross-section of the panel joint taken along line 3—3 of FIG. 1 or FIG. 2 of this invention. The exterior facing metal skin 31 is formed with a female groove 32 on one side and a male leg 33 on the other side. Similarly, the interior facing metal skin 34 is formed with a female groove 35 on one side and a male leg 36 on the other side. The structural core 37, either of foam or honeycomb material, is bonded to the exterior skin 31 and the interior skin 34 by chemical or adhesive bond to develop the composite action between the two metal skins 31 and 34. To maintain a good thermal insulation value, the exterior skin 31 is not in contact with the interior skin 34. The primary weather seal 38 of gasket or caulking is provided in the female groove 35 of the interior skin 34. The secondary weather seal 39 of gasket or caulking is provided in the female groove 32 of the exterior skin 31. If the structural core 37 is made of closed cell foam material, the secondary seal 39 may be omitted. Both the male legs 33 and 36 are arranged on one side of the panel and both the female grooves 32 and 35 are arranged on the other side of the panel.

To fasten the panel into the support 40 (shown as 14 in FIG. 1 and 23 in FIG. 2), a clip 41 (FIG. 4) having at least one leg 42 penetrating through the exterior male leg 33 is placed into position. The fastener 43, screw or bolt, is applied through the clip 41, the exterior male leg 33, and the interior skin 34 into the support 40. In this manner, the panel side containing the male legs 33 and 36 is the fastening side 24. Since the exterior skin 31 is mechanically held in position by the penetrating clip leg 42 and fastener 43 through the exterior male leg 33, the exterior skin delamination is highly restrained under negative load condition.

The female grooves 32 and 35 are positioned to cause engagement with the male legs 33 and 36, respectively. The panel side containing the female grooves 32 and 35 is the engaging side 25. An inwardly sloping (i.e. sloping toward the mid-width of the panel) surface 44 is provided in the interior skin 34 on the side containing the female groove 35. An outwardly sloping (i.e. sloping away from the mid-width of the panel) surface 45 is provided in the interior skin on the side containing the male leg 36.

After the panel is fastened to the support 40 on the fastening side 24, the engaging side 25 of the next panel is placed into position by engaging the female grooves 32 and 35 with the male legs 33 and 36, respectively, of the already installed panel. Upon panel engagement, the sloping surfaces 44 and 45 are substantially parallel to each other. A minimum gap "A" in the order of one-eighth of an inch (3.2 mm) between the interior skins 34 is recommended for fabrication and erection tolerances. Under negative wind load condition, the engaging side 25 will move outwardly creating the tendency of sidejoint separation. After the initial sidejoint movement has been absorbed by the interior sidejoint gap "A", the sloping surfaces 44 and 45 will come in contact with each other and further sidejoint separation tendency will be resisted by the wedge action between the two sloping surfaces 44 and 45.

The restraint provided by the wedge action is significantly higher than that provided by the male legs alone (i.e. the prior art design), such that the wall failure under negative wind load would never be governed by sidejoint separation. In the engaged panel position, the panel edge 46 of the engaging side 25 is extended to conceal the fastener from exterior viewing creating a fastener pocket 47. The exterior skin 31 on the fastening side 24 are provided with two steps—the first step 48 forms the male leg 33 of the exterior skin 31 and the second step 49 forms the reveal sidejoint surface 50 having a width of reveal, "B" dimension. It is preferred to provide a slight slope on the steps 48 and 49 to help water drainage when the panels are erected in the horizonal mode. A minimum exterior sidejoint gap, dimension "B", in the order of one-eighth of an inch (3.18 mm) is recommended for fabrication and erection tolerances as well as allowance for thermal expansion. When the exterior sidejoint gap, dimension "B" is small, the second step 49 may be eliminated provided that the first step 48 is extended to the exterior panel surface and will clear the panel edge 46. It is readily seen that the pressure inside the fastener pocket 47 is equalized with the air pressure of the exterior environment and thus, no water can stay beyond the exterior surface of the wall when the panels are erected in the horizontal mode and the sealing integrity of the joint is fully protected. It is also readily seen that any desirable width of reveal, dimension "B", can be accommodated without affecting the sidejoint disengagement strength. It is also readily seen that when the panels are erected in the horizontal mode, the erection can be conveniently proceeded in an upward fashion with easy panel engagements.

Figure 4:
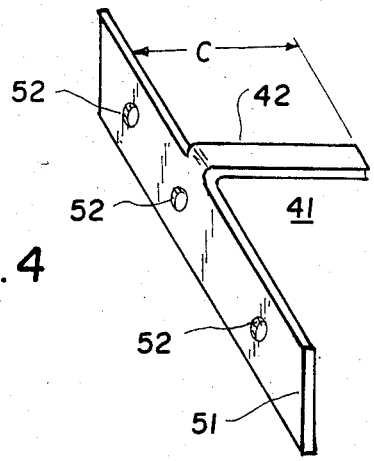
FIG. 4 is an isometric view of a typical panel connecting clip of this invention.

FIG. 4 shows the isometric view of a typical connecting clip 41 adaptable for use in conjunction with the sidejoint design of this invention. The clip 41 has at least one leg 42 having a length of dimension "C" being equal to the distance between the exterior male leg 33 (see FIG. 3) and the interior skin 34 (see FIG. 3). The leg 42 is used to prevent the depression of the exterior male leg 33 (see FIG. 3) due to the tightening force of the fastener 43 (see FIG. 3). The clip 41 also has a flat top 51 with at least one fastener hole 52. The flat top 51 is acting as a washer of the fastener. The clip 41 can be made of galvanized steel, aluminum, or stainless steel. Depending on the load requirement, the practical thickness of the clip material ranges from 0.05 inches (1.27 mm) to 0.125 inches (3.18 mm).

While I have illustrated and described several embodiments of my invention, it will be understood that these are by way of illustration only and that various changes and modifications may be contemplated in my invention and within the scope of the following claims:

I claim:

1. In a building panel wall assembly formed from individual building panels, each panel having an outer metal facing sheet, an inner metal facing sheet and a structural core adhesively connecting said metal sheets, wherein said outer facing sheet and said inner facing sheet have lateral profiled joint-forming surfaces for connecting a pair of said panels in side-by-side relation to a building frame, the panel depth being the distance between said facing sheets; the improvement comprising said outer and inner facing sheets of said panel being reversely bent on one side of said panel and each terminating in an integral reversely bent female joint, said outer and inner facing sheets of said panel being offset inwardly and each terminating in an integral male joint on the other side of said panel, which male joints are positioned to interfit with said female joints, a fastener extending through both said outer and inner facing sheets and in the vicinity of said male joints for fastening both of said male joints to a wall panel support, said reversely bent outer facing being extended sufficiently to conceal from view said male and female joints and said fastener.

2. The building panel wall assembly of claim 1 together with weather seals contained in said female joints.

3. The building wall assembly of claim 1 together with a clip having an end resting against an inner surface of one of said inner facing sheets for limiting the extent of tightening of said one of said male joints.

4. The building wall assembly of claim 3 wherein said fastener is a screw having a head resting against said clip, and wherein the outer facing sheet which terminates in said fastened male joint is stepped to form a fastener pocket to conceal said bolt head and clip.

5. The building wall assembly of claim 4 wherein said clip comprises two integral portions at right angles, one having a bolt hole.

6. The building wall assembly of claim 1 wherein said inner facing sheet at each side of said panel is sloped along a substantially straight plane so as to be in close parallel relationship to an inwardly offset inner facing sheet of the adjoining panel.

7. The building wall assembly of claim 6 wherein said close parallel relationship is sufficiently small and a minimum of about ⅛-inch to enable the parallel surfaces to contact each other under certain wind load conditions

8. The building wall assembly of claim 1 wherein said female joints are vertically offset from each other.

9. The building wall assembly of claim 1 wherein said reversely bent portions of said outer and inner facing sheets are spaced, from an adjoining panel, downwardly and outwardly from both of said male and female joints when adjoining panels are stacked in the horizontal mode so as to effectively drain water therefrom to the outer surfaces of the lower panel.

10. The building wall assembly of claim 9 wherein one of said inner facing sheets of said lower panel which is associated with said fastener is stepped while the other is flat.

* * * * *